United States Patent [19]

Yusuke et al.

[11] Patent Number: 4,908,279

[45] Date of Patent: Mar. 13, 1990

[54] MULTILAYER ELECTROPLATED STEEL SHEET

[75] Inventors: Hirose Yusuke, Minamikawachi; Uchida Yukio, Amagasaki; Kato Yoshio, Nishinomiya; Hisada Kazuyuki, Amagasaki; Watanabe Koichi, Amagasaki; Sakai Nobuhiko, Amagasaki; Miyoshi Yasushi, Izumisano, all of Japan

[73] Assignee: Nisshin Steel Co., Ltd., Tokyo, Japan

[21] Appl. No.: 144,925

[22] PCT Filed: Jun. 12, 1987

[86] PCT No.: PCT/JP87/00378

§ 371 Date: Dec. 31, 1987

§ 102(e) Date: Dec. 31, 1987

[87] PCT Pub. No.: WO88/04335

PCT Pub. Date: Jun. 16, 1988

[30] Foreign Application Priority Data

Dec. 6, 1986 [JP] Japan ..... 61-291374

[51] Int. Cl.[4] ..... B32B 15/18

[52] U.S. Cl. ..... 428/659; 428/681; 428/935

[58] Field of Search ..... 428/614, 659, 681, 935

[56] References Cited

U.S. PATENT DOCUMENTS

| | | | |
|---|---|---|---|
| 4,491,623 | 1/1985 | Kokubo et al. | 428/935 |
| 4,510,209 | 4/1985 | Hada et al. | 428/659 |

FOREIGN PATENT DOCUMENTS

| | | | |
|---|---|---|---|
| 174019 | 3/1986 | European Pat. Off. | 428/659 |
| 54-146228 | 11/1979 | Japan . | |
| 60-138093 | 7/1985 | Japan . | |
| 207558 | 9/1986 | Japan | 428/659 |

*Primary Examiner*—Robert McDowell

*Attorney, Agent, or Firm*—Foley & Lardner, Schwartz, Jeffery, Schwaab, Mack, Blumenthal & Evans

[57] ABSTRACT

Conventional electroplated steel sheets of Zn alloys of Zn-Ni base, Zn-Fe base, etc., having a poor phosphating performance, have been involved in the problems such that when used for automobile bodies, craterings may be generated on coating films at the time of electrodeposition coating to damage the coating appearance, or that only poor corrosion resistance and pin holing resistance can be achieved at the portions where no coating film is applied or only a thin coating film is applied for structural reasons of automobile bodies.

To solve such problems, this invention provides a multilayer zinc metal electroplated steel sheet comprising (i) a lower layer electroplated coating provided on the surface of the steel sheet and comprising a Zn-Ni base alloy having Ni content of 10 to 16 wt. % or Zn-Fe base alloy having Fe content of 10 to 30 wt. %, containing 0.005 to 5 wt. % of at least one of silica, alumina, titanium oxide, magnesia, chromium oxide and zirconium oxide, and (ii) an upper layer electroplated coating provided on said lower layer electroplated coating and comprising an Fe-B base alloy having B (boron) content of 0.001 to 3 wt. % or an Fe-rich Fe-Zn base alloy having Fe content of 60 wt. % or more, so that the lower layer may contribute the improvement in the corrosion resistance and pin holing resistance and the upper layer may contribute the improvement in the phosphating performance.

The lower layer may preferably have a coating weight of 10 to 50 g/m$^2$ per one side, and the upper layer may preferably have a coating weight of 0.5 to 10 g/m$^2$ per one side.

4 Claims, No Drawings

MULTILAYER ELECTROPLATED STEEL SHEET

TECHNICAL FIELD

This invention relates to a multilayer electroplated steel sheet that can have good coating appearance, and also can exhibit good corrosion resistance even in a corrosive environment like a road on which antifreezing agents such as rock salt have been sprayed.

BACKGROUND ART

Zinc metal-plated steel sheets, provided with a coating having a good sacrificial corrosion resistant ability, have hitherto widely used for the purposes in which corrosion resistance is required as in the various fields of automobiles, household electrical equipments, building materials, etc. When this zinc metal-plated steel sheets are used in automobile bodies as in recent years, they may be placed in a severe corrosive environment because antifreezing agents such as rock salt are sprayed on a road in winter as in the cold countries such as North America, Canada and elsewhere. Accordingly, they are required to have excellent blistering resistance, corrosion resistance and pin holing resistance even under such an environment.

As the zinc metal-plated steel sheets for use in automobiles, there have been hitherto chiefly used hot dip zinc-coated steel sheets, zinc-electroplated steel sheets and so forth, but it is difficult for these coated or plated steel sheets to achieve a sufficient performance in such severe use as mentioned above. Accordingly, recently developed are electroplated steel sheets of Zn alloys of a Zn-Ni base, Zn-Fe base, etc.

However, since these coated steel sheets have a poor phosphating performance, they have been involved in the problems such that craterings may be generated on coating films at the time of electrodeposition coating to damage the coating appearance, or that only poor corrosion resistance and pin holing resistance can be achieved at the portions where no coating film is applied or only a thin coating film is applied for structural reasons of automobile bodies as in the portions where plates are joined or hollow structure is taken.

To solve such problems, this invention aims at providing a multilayer zinc metal-electroplated steel sheet having a good phosphating performance, having good corrosion resistance and pin holing resistance even at the portoions where no coating film is applied or only a thin coating film is applied, and moreover having a good coating appearance.

DISCLOSURE OF THE INVENTION

This invention provides the multilayer zinc metal-electroplated steel sheet which is comprised of a multilayer zinc metal electroplated steel sheet comprising (i) a lower layer electroplated coating provided on the surface of the steel sheet and comprising a Zn-Ni base alloy having Ni content of 10 to 16 wt.% or Zn-Fe base alloy having Fe content of 10 to 30 wt.%, containing 0.005 to 5 wt.% of at least one of silica, alumina, titanium oxide, magnesia, chromium oxide and zirconium oxide, and (ii) an upper layer electroplated coating provided on said lower layer electroplated coating and comprising an Fe-B base alloy having B (boron) content of 0.001 to 3 wt.% or an Fe-rich Fe-Zn base alloy having Fe content of 60 wt.% or more, thereby improving the phosphating performance (i.e., coating appearance), corrosion resistance and pin holing resistance.

This plated steel sheet was developed based on the finding that the corrosion resistance and pin holing resistance can be improved by co-depositing 0.005 to 5 wt.% of particles of oxides such as silica, alumina, titanium oxide, magnesia, chromium oxide and zirconium oxide in a conventional Zn-Ni base alloy or Zn-Fe base alloy coating of an electroplated steel sheet.

However, when the coating contains such chemically stable oxide particles, it was found that the performance of the phosphating carried out before electrodeposition coating may be lowered and a large number of craterings may be generated in a coating film at the time of the electrodeposition coating to damage the appearance. Thus, in the present invention, an Fe-B base alloy or Fe-rich Fe-Zn base alloy coating is further applied on the electroplated coating on which the oxide particles as mentioned above have been deposited in a dispersed state, so that the generation of craterings on the coating film formed at the time of the electrodeposition coating can be restrained. In the present invention, the corrosion resistance and pin holing resistance can be improved by codepositing and dispersing the oxide particles as mentioned above on the lower layer Zn-Ni or Zn-Fe base alloy coating. This is presumably because the oxide particles may promote the formation of corrosive products of ungrowable type when corrosion reaches the lower layer, to block the advance of crossion to its inside.

Best mode for working the invention

The particles of oxides such as silica, alumina, titanium oxide, magnesia, chromium oxide and zirconium oxide to be contained in the lower layer should be contained in an amount of 0.005 to 5 wt.%. This is because the amount less than 0.005 wt.% may result in almost no effect of the addition in respect of the corrosion resistance and pin holing resistance, and also, even if they are contained in an amount more than 5 wt.%, not only no remarkable effect for improving the corrosion resistance and pin holing resistance can be achieved as compared with the case they are added in the amount not more than 5 wt.%, but also there may be caused a problem that the particles agglomerate since the oxide particles must be added in a large amount to a plating bath in order to co-deposit them in the amount more than 5 wt.% at the time of electroplating.

Also, the Ni content in the case the lower layer comprises the Zn-Ni base alloy should be controlled to 10 to 16 wt.%. This is because the content less than 10 wt.% may result in an alloy phase comprising a $(\gamma+\eta)$-phase deposited film, and the content more than 16 wt.% may result in the formation of a double phase deposited film of $(\gamma+\alpha)$-phase to form local cells caused by the contact of different phases in a coating to lower the corrosion resistance. In contrast thereto, the Ni content of 10 to 16 wt.% may result the alloy phase of a single phase comprising $\gamma$ phase and no formation of local cells in the coating, whereby good corrosion resistance can be achieved.

The Fe content in the case the lower layer comprises the Zn-Fe base alloy should be controlled to 10 to 30 wt.%. This is because the content less than 10 wt.% may result in an alloy phase chiefly comprised of an $\eta$ phase to give substantially the same sacrificial corrosion resistant ability with a zinc coating to make too large the corrosion rate, and the content more than 30 wt.% may result in an alloy phase chiefly comprised of a Γ phase which is hard and brittle, so that powdering may take place in the coating when the steel sheet is worked out for a member of an automobile body. In contrast thereto, the content of 10 to 30 wt.% may result an alloy phase chiefly comprised of δ1, which is electrochemically nobler than a pure zinc or the η phase, so that the corrosion rate may become small to enable the long term protection of the bodies of steel.

The lower layer may preferably have a coating weight of 10 to 50 g/m$^2$ in either alloy plating. This is because the coating weight of less than 10 g/m$^2$ may result in corrosion of the mother material before corrosive products are formed when a coating is corroded, so that it can not be expected to achieve the improvement of the corrosion resistance and pin holing resistance by the lower layer, and also because the plating in the coating amount of more than 50 g/m$^2$ may readily cause occurrence of the powdering of a coating at the time of forming.

The boron content in the case the upper layer comprises the Fe-B base alloy should be controlled to 0.001 to 3 wt.%. This is because the content less than 0.001 wt.% may result in no difference in the quantity of the generation of craterings on a coating film at the time of electrodeposition coating, from the case of an Fe coating where no boron is contained, and the content even more than 3 wt.% may result in saturation of the effect so that it may be meaningless to make the content larger than that. .

In order to co-deposit boron in the Fe coating in an amount of 0.001 to 3 wt.%, the plating may be carried out by adding one or more of boron compound(S) such as boric acid, metaboric acid, soluble metaboric acid, soluble tetraboric acid and tetrafluoroboric acid to an ordinary Fe plating bath, and adjusting the pH of the bath to 1.5 to 4.

The Fe content in the case the upper layer comprises the Fe-rich Fe-Zn base alloy should be controlled to 60 wt.% or more. This is because the content less than 60 wt.% may cause frequent generation of craterings on a coating film at the time of the electrodeposition coating to worsen the finishing of the coating.

The upper layer may preferably have a coating weight of 0.5 to 10 g/m$^2$ per one side in either alloy plating. This is because the coating weight of less than 10 g/m$^2$ may result in imperfect covering on the surface of the lower layer to make poor the phosphating performance, and the content even more than 10 g/m$^2$ may not bring about any more remarkable effect in the phosphating performance to only cause a disadvantage from a viewpoint of the cost.

The upper layer may be further effective in that it can cover projected oxide particles in the lower layer so that a tip of a welding machine used in electrical resistance welding may be brought into uniform contact with the coating, and abrasion of the tip of a welding machine or dragging of a pressing mold can be prevented.

The coatings for the lower layer and upper layer in the present invention can be both obtained by carrying out the plating in a sulfuric acid type plating bath or in a chloride bath. Here, the oxide particles to be added to a plating bath for the lower layer may be in the form of either fine particles or a colloidal sol.

In the present invention, in order to further increase the corrosion resistance, a small amount of one or more of corrosion resistance improving element(s) such as Co, Cr, Ti, Ni, Mo and Mn may be added to the lower layer or upper layer.

EXAMPLE 1

On a cold rolled steel sheet, pre-treatments such as degreasing and acid pickling were applied according to a conventional method, followed by electroplating for a lower layer of a Zn-Ni base alloy containing oxide particles, under the following conditions:

(1) Composition of plating bath:

| | |
|---|---|
| Nickel sulfate | 260 g/lit. |
| Zinc sulfate | 150 g/lit. |
| Sodium sulfate | 70 g/lit. |
| Oxide powder | 10 to 50 g/lit. |

(2) Plating conditions:

| | |
|---|---|
| pH | 2.0 |
| Bath temperature | 55° C. |
| Current density | 40 A/dm$^2$ |

The following were used as the oxide powder added to the plating bath, and the content thereof in the coating was controlled by the amount for the addition.

| Oxide powder | Average particle size |
|---|---|
| Silica ($SiO_2$) | 16 mμ |
| Alumina ($Al_2O_3$) | 20 mμ |
| Titanium oxide ($TiO_2$) | 30 mμ |
| Magnesia (MgO) | 30 mμ |
| Chromium oxide ($Cr_2O_3$) | 50 mμ |
| Zirconium oxide ($ZrO_2$) | 30 mμ |

Subsequently, on this lower layer, electroplating for an upper layer of an Fe-rich Fe-Zn base alloy or an Fe-B base alloy was carried out under the following conditions:

(1) Fe-rich Fe-Zn base alloy:

| | |
|---|---|
| (A) Composition of plating bath | |
| Ferrous sulfate | 280 g/lit. |
| Zinc sulfate | 0 to 75 g/lit. |
| Sodium sulfate | 85 g/lit. |
| (B) Plating conditions | |
| pH | 1.6 |
| Bath temperature | 50° C. |
| Current density | 20 to 60 A/dm$^2$ |

The Fe content was controlled by the combination of zinc sulfate concentration with current density.

(2) Fe-B base alloy:

(A) Composition of plating bath:

| | |
|---|---|
| (A) Composition of plating bath | |
| Ferrous sulfate | 250 g/lit. |
| Sodium sulfate | 70 g/lit. |
| Tartaric acid | 3 g/lit. |
| Sodium metaborate | 10 to 50 /lit. |
| (B) Plating conditions | |
| pH | 2.0 to 4.0 |
| Bath temperature | 60° C. |
| Current density | 40 A/dm$^2$ |

The boron content was controlled by the combination of sodium metaborate concentration with the pH.

Next, the electroplated steel sheets and comparative samples obtained in the above manner were subjected to phosphating (using Bondelite #3030, produced by Nippon Parkarising Co.) to carry out cation electrodeposition coating (using Powertop U-30, produced by Nippon Paint Co., Ltd.; coating film thickness: 20 μm), and thereafter the following tests were carried out:

(1) Electrodeposition coating performance:

Craterings generated on a coating film in the area of 5 cm×5 cm were counted, and evaluated according to the following criteria:

| | |
|---|---|
| Less than 5 | A |
| 5 to 50 craterings | B |
| More than 50 | C |

(2) Coating film adhesion:

Cross cuts reaching to the steel body were made on coated steel sheets, and a composite cycle test with one cycle as shown below was repeated 50 times. After the tests, the maximum width of blisterings generated from the cross-cut portion on a coating film was measured to make evaluation according the criteria shown below.

(A) Composite cycle test:

Salt water spraying test (JIS Z 2371) for 12 hrs→Drying at 60° C. for 6 hrs→Wetting test (50° C.; RH: 95% or more) for 6 hrs.

(B) Evaluation criteria:

| | |
|---|---|
| Less than 3 mm | A |
| 3 to 10 mm | B |
| More than 10 mm | C |

(3) Pin holing resistance:

After a composite cycle test similar to that for the above coating film adhesion was carried out by 50 cycles, the maximum depth of the corrosion of the steel body in the vicinity of the cross-cut portion was measured to make evaluation according to the following criteria:

| | |
|---|---|
| Less than 0.1 mm | A |
| 0.1 to 0.2 mm | B |
| More than 0.2 mm | C |

(4) Powdering:

Deep draw processing was carried out on uncoated electroplated steel sheets, and cellophane tapes were adhered on the processed portions and thereafter peeled off to evaluate according to the following criteria the state of adhesion of coating metal powder to the tapes.

| | |
|---|---|
| Adhesion to a tape was in a very small amount | A |
| Adhesion to a tape was in a small amount | B |
| Adhesion to a tape was in a large amount | C |

Results obtained in the case the upper layer comprises the Fe-B base alloy are shown in Tables 1 to 3, and results obtained in the case the upper layer comprises the Fe-rich Fe-Zn base alloy are shown in Tables 4 to 6.

TABLE 1

| | Lower layer coating | | | |
|---|---|---|---|---|
| | | Oxide powder | | |
| Group | Ni content (wt. %) | Kind | Codeposit amount (wt. %) | Coating weight (per one side) ($g/m^2$) |
| Present invention | | | | |
| 1 | 14 | $Al_2O_3$ | 0.10 | 20 |
| 2 | 11 | " | 2.00 | 20 |
| 3 | 14 | $SiO_2$ | 0.30 | 20 |
| 4 | 16 | " | 1.50 | 20 |
| 5 | 13 | $TiO_2$ | 0.02 | 20 |
| 6 | 12 | " | 1.00 | 20 |
| 7 | 15 | MgO | 0.08 | 20 |
| 8 | 11 | " | 2.50 | 20 |
| 9 | 10 | $Cr_2O_3$ | 0.60 | 20 |
| 10 | 13 | " | 1.80 | 20 |
| 11 | 14 | $ZrO_2$ | 0.07 | 20 |
| 12 | 12 | " | 1.60 | 20 |
| Comparative example | | | | |
| 1 | 11 | $Al_2O_3$ | 2.00 | 25 |
| 2 | 12 | $TiO_2$ | 1.00 | 27 |
| 3 | 11 | MgO | 2.50 | 25 |
| 4 | 10 | $Cr_2O_3$ | 0.60 | 25 |
| 5 | 12 | None | — | 23 |

TABLE 2

| | Upper layer coating | | |
|---|---|---|---|
| Group | B content (wt. %) | Coating weight (per one side) ($g/m^2$) | Total coating weight for lower and upper layers (per one side) ($g/m^2$) |
| Present invention | | | |
| | 0.050 | 4 | 24 |
| 2 | 0.040 | 5 | 25 |
| 3 | 0.009 | 4 | 24 |
| 4 | 0.010 | 6 | 26 |
| 5 | 0.005 | 5 | 25 |
| 6 | 0.006 | 7 | 27 |
| 7 | 0.010 | 4 | 24 |
| 8 | 0.020 | 5 | 25 |
| 9 | 0.030 | 5 | 25 |
| 10 | 0.015 | 6 | 26 |
| 11 | 0.008 | 4 | 24 |
| 12 | 0.012 | 6 | 26 |
| Comparative example | | | |
| 1 | — | — | 25 |
| 2 | — | — | 27 |
| 3 | — | — | 25 |
| 4 | — | — | 25 |
| 5 | — | — | 23 |

TABLE 3

| Group | Electrodeposition coating performance | Coating film adhesion | Pin holing resistance | Powdering | Overall evaluation |
|---|---|---|---|---|---|
| Present invention | | | | | |
| 1 | A | A | A | A | A |
| 2 | A | A | A | A | A |
| 3 | A | A | A | A | A |
| 4 | A | A | A | A | A |
| 5 | A | A | A | A | A |
| 6 | A | A | A | A | A |
| 7 | A | A | A | A | A |
| 8 | A | A | A | A | A |
| 9 | A | A | A | A | A |
| 10 | A | A | A | A | A |
| 11 | A | A | A | A | A |
| 12 | A | A | A | A | A |
| Comparative example | | | | | |
| 1 | B | B | A | B | B |
| 2 | B | B | A | B | B |
| 3 | B | B | A | B | B |

TABLE 3-continued

| Group | Electro-deposition coating performance | Coating film adhesion | Pin holing resistance | Powdering | Overall evaluation |
|---|---|---|---|---|---|
| 4 | B | B | A | B | B |
| 5 | B | A | C | A | B |

Overall evaluation
A: Good; B: Somewhat poor; C: Poor

TABLE 4

| Group | Ni content (wt. %) | Lower layer coating: Oxide powder: Kind | Codeposit amount (wt. %) | Coating weight (per one side) ($g/m^2$) |
|---|---|---|---|---|
| Present invention | | | | |
| 21 | 13 | $Al_2O_3$ | 0.40 | 20 |
| 22 | 12 | " | 2.50 | 20 |
| 23 | 14 | $SiO_2$ | 0.50 | 20 |
| 24 | 15 | " | 1.00 | 20 |
| 25 | 14 | $TiO_2$ | 0.02 | 20 |
| 26 | 16 | " | 0.10 | 20 |
| 27 | 11 | MgO | 0.12 | 20 |
| 28 | 12 | " | 0.11 | 20 |
| 29 | 13 | $Cr_2O_3$ | 0.04 | 20 |
| 30 | 13 | " | 0.11 | 20 |
| 31 | 14 | $ZrO_2$ | 0.08 | 20 |
| 32 | 12 | " | 0.22 | 20 |
| Comparative example | | | | |
| 21 | 14 | $Al_2O_3$ | 1.20 | 24 |
| 22 | 13 | $SiO_2$ | 1.80 | 23 |
| 23 | 14 | $TiO_2$ | 0.90 | 25 |
| 24 | 12 | $ZrO_2$ | 0.80 | 26 |
| 25 | 13 | None | — | 30 |

TABLE 5

| Group | Fe content (wt. %) | Upper layer coating: Coating weight (per one side) ($g/m^2$) | Total coating weight for lower and upper layers (per one side) ($g/m^2$) |
|---|---|---|---|
| Present invention | | | |
| 21 | 75 | 4 | 24 |
| 22 | 80 | 5 | 25 |
| 23 | 65 | 5 | 25 |
| 24 | 70 | 5 | 25 |
| 25 | 70 | 6 | 26 |
| 26 | 78 | 4 | 24 |
| 27 | 85 | 6 | 26 |
| 28 | 88 | 4 | 24 |
| 29 | 75 | 4 | 24 |
| 30 | 80 | 6 | 26 |
| 31 | 90 | 6 | 26 |
| 32 | 95 | 4 | 24 |
| Comparative example | | | |
| 21 | — | — | 24 |
| 22 | — | — | 23 |
| 23 | — | — | 25 |
| 24 | — | — | 26 |
| 25 | — | — | 30 |

TABLE 6

| Group | Electro-deposition coating performance | Coating film adhesion | Pin holing resistance | Powdering | Overall evaluation |
|---|---|---|---|---|---|
| Present invention | | | | | |
| 21 | A | A | A | A | A |
| 22 | A | A | A | A | A |
| 23 | A | A | A | A | A |

TABLE 6-continued

| Group | Electro-deposition coating performance | Coating film adhesion | Pin holing resistance | Powdering | Overall evaluation |
|---|---|---|---|---|---|
| 24 | A | A | A | A | A |
| 25 | A | A | A | A | A |
| 26 | A | A | A | A | A |
| 27 | A | A | A | A | A |
| 28 | A | A | A | A | A |
| 29 | A | A | A | A | A |
| 30 | A | A | A | A | A |
| 31 | A | A | A | A | A |
| 32 | A | A | A | A | A |
| Comparative example | | | | | |
| 21 | B | B | A | B | B |
| 22 | B | B | A | B | B |
| 23 | B | B | A | B | B |
| 24 | B | B | A | B | B |
| 25 | B | A | C | A | B |

Overall evaluation
A: Good; B: Somewhat poor; C: Poor

EXAMPLE 2

Pre-treatments similar to those in Example 1 were applied on a cold rolled steel sheet, followed by electroplating for a lower layer of a Zn-Fe alloy containing oxide particles, in the following manner:

(1) Composition of plating bath:

| | |
|---|---|
| Ferrous sulfate | 300 g/lit. |
| Zinc sulfate | 50 to 100 g/lit. |
| Sodium sulfate | 70 g/lit. |
| Oxide powder | 10 to 50 g/lit. |

(2) Plating conditions:

| | |
|---|---|
| pH | 1.5 to 2.5 |
| Bath temperature | 55° C. |
| Current density | 40 $A/dm^2$ |

The Fe content was controlled by the combination of zinc sulfate concentration with the pH. As the oxide powder added to the plating bath, there were added those same as those added in Example 1, and the content thereof in the coating was controlled by the amount of the addition.

After the electroplating for the lower layer was carried out in the above manner, electroplating for an upper layer comprising the Fe-rich Fe-Zn alloy or the Fe-B alloy was subsequently carried out under the following conditions, and the post-coating treatment, electrodeposition coating and tests were carried out in the same manner as in Example 1 to make evaluation according to the same criteria.

(1) Fe-rich Fe-Zn alloy:

(A) Composition of plating bath:

Same as in Example 1

(B) Plating conditions:

| | |
|---|---|
| pH | 1.5 to 2.5 |
| Bath temperature | 50° C. |
| Current density | 20 to 60 $A/dm^2$ |

(2) Fe-B alloy:

(A) Composition of plating bath:

Same as in Example 1.

(B) Plating conditions:

Same as in Example 1.

The Fe content in the upper layer was controlled by the combination of zinc sulfate concentration with the pH, and the boron content was controlled by the combination of sodium metaborate concentration with the pH.

Results obtained in the case the upper layer comprises the Fe-B alloy are shown in Tables 7 to 9, and results obtained in the case the upper layer comprises the Fe-rich Fe-Zn alloy are shown in Tables 10 to 12.

TABLE 7

| | | Lower layer coating | | |
|---|---|---|---|---|
| | | Oxide powder | | Coating |
| Group | Fe content (wt. %) | Kind | Codeposit amount (wt. %) | weight (per one side) ($g/m^2$) |
| Present invention | | | | |
| 51 | 15 | $Al_2O_3$ | 0.30 | 23 |
| 52 | 21 | " | 1.10 | 20 |
| 53 | 20 | $SiO_2$ | 0.40 | 24 |
| 54 | 17 | " | 0.80 | 24 |
| 55 | 14 | $TiO_2$ | 0.08 | 24 |
| 56 | 22 | " | 0.90 | 26 |
| 57 | 18 | MgO | 1.20 | 24 |
| 58 | 14 | " | 0.60 | 23 |
| 59 | 23 | $Cr_2O_3$ | 0.80 | 25 |
| 60 | 15 | " | 1.10 | 24 |
| 61 | 19 | $ZrO_2$ | 0.70 | 25 |
| 62 | 24 | " | 1.50 | 23 |
| Comparative example | | | | |
| 51 | 21 | $Al_2O_3$ | 0.30 | 27 |
| 52 | 17 | $SiO_2$ | 0.80 | 27 |
| 53 | 18 | MgO | 1.20 | 27 |
| 54 | 19 | $ZrO_2$ | 0.70 | 27 |
| 55 | 15 | None | — | 25 |

TABLE 8

| | | Upper layer coating | |
|---|---|---|---|
| Group | B content (wt. %) | Coating weight (per one side) ($g/m^2$) | Total coating weight for lower and upper layers (per one side) ($g/m^2$) |
| Present invention | | | |
| 51 | 0.080 | 4 | 27 |
| 52 | 0.100 | 7 | 27 |
| 53 | 0.009 | 3 | 27 |
| 54 | 0.030 | 4 | 28 |
| 55 | 0.070 | 3 | 27 |
| 56 | 0.200 | 2 | 28 |
| 57 | 0.050 | 3 | 27 |
| 58 | 0.100 | 4 | 27 |
| 59 | 0.008 | 3 | 28 |
| 60 | 0.250 | 3 | 27 |
| 61 | 0.070 | 2 | 27 |
| 62 | 0.110 | 5 | 28 |
| Comparative example | | | |
| 51 | — | — | 27 |
| 52 | — | — | 27 |
| 53 | — | — | 27 |
| 54 | — | — | 27 |
| 55 | — | — | 25 |

TABLE 9

| Group | Electro-deposition coating performance | Coating film adhesion | Pin holing resistance | Powdering | Overall evaluation |
|---|---|---|---|---|---|
| Present invention | | | | | |
| 51 | A | A | A | A | A |
| 52 | A | A | A | A | A |
| 53 | A | A | A | A | A |

TABLE 9-continued

| Group | Electro-deposition coating performance | Coating film adhesion | Pin holing resistance | Powdering | Overall evaluation |
|---|---|---|---|---|---|
| 54 | A | A | A | A | A |
| 55 | A | A | A | A | A |
| 56 | A | A | A | A | A |
| 57 | A | A | A | A | A |
| 58 | A | A | A | A | A |
| 59 | A | A | A | A | A |
| 60 | A | A | A | A | A |
| 61 | A | A | A | A | A |
| 62 | A | A | A | A | A |
| Comparative example | | | | | |
| 51 | B | B | A | B | B |
| 52 | B | B | A | B | B |
| 53 | B | B | A | B | B |
| 54 | B | B | A | B | B |
| 55 | B | A | C | A | B |

Overall evaluation

A: Good; B: Somewhat poor; C: Poor

TABLE 10

| | | Lower layer coating | | |
|---|---|---|---|---|
| | | Oxide powder | | Coating |
| Group | Fe content (wt. %) | Kind | Codeposit amount (wt. %) | weight (per one side) ($g/m^2$) |
| Present invention | | | | |
| 71 | 14 | $Al_2O_3$ | 0.50 | 24 |
| 72 | 16 | " | 1.20 | 24 |
| 73 | 13 | $SiO_2$ | 0.40 | 20 |
| 74 | 19 | " | 0.95 | 25 |
| 75 | 11 | $TiO_2$ | 0.09 | 20 |
| 76 | 14 | " | 0.50 | 26 |
| 77 | 12 | MgO | 1.00 | 21 |
| 78 | 18 | " | 0.85 | 24 |
| 79 | 14 | $Cr_2O_3$ | 0.60 | 24 |
| 80 | 20 | " | 1.20 | 20 |
| 81 | 12 | $ZrO_2$ | 0.80 | 21 |
| 82 | 17 | " | 1.10 | 25 |
| Comparative example | | | | |
| 71 | 16 | $Al_2O_3$ | 0.50 | 27 |
| 72 | 19 | $SiO_2$ | 0.95 | 26 |
| 73 | 18 | MgO | 0.85 | 28 |
| 74 | 17 | $ZrO_2$ | 1.10 | 28 |
| 75 | 12 | None | — | 23 |

TABLE 11

| | | Upper layer coating | |
|---|---|---|---|
| Group | Fe content (wt. %) | Coating weight (per one side) ($g/m^2$) | Total coating weight for lower and upper layers (per one side) ($g/m^2$) |
| Present invention | | | |
| 71 | 68 | 3 | 27 |
| 72 | 75 | 4 | 28 |
| 73 | 75 | 6 | 26 |
| 74 | 90 | 2 | 27 |
| 75 | 85 | 8 | 28 |
| 76 | 70 | 3 | 29 |
| 77 | 80 | 5 | 26 |
| 78 | 75 | 4 | 28 |
| 79 | 80 | 4 | 28 |
| 80 | 75 | 6 | 26 |
| 81 | 85 | 5 | 26 |
| 82 | 82 | 3 | 28 |
| Comparative example | | | |
| 71 | — | — | 27 |
| 72 | — | — | 26 |
| 73 | — | — | 28 |
| 74 | — | — | 28 |

TABLE 11-continued

| Group | Upper layer coating: Fe content (wt. %) | Coating weight (per one side) ($g/m^2$) | Total coating weight for lower and upper layers (per one side) ($g/m^2$) |
|---|---|---|---|
| 75 | — | — | 23 |

TABLE 12

| Group | Electro-deposition coating performance | Coating film adhesion | Pin holing resistance | Powdering | Overall evaluation |
|---|---|---|---|---|---|
| Present invention | | | | | |
| 71 | A | A | A | A | A |
| 72 | A | A | A | A | A |
| 73 | A | A | A | A | A |
| 74 | A | A | A | A | A |
| 75 | A | A | A | A | A |
| 76 | A | A | A | A | A |
| 77 | A | A | A | A | A |
| 78 | A | A | A | A | A |
| 79 | A | A | A | A | A |
| 80 | A | A | A | A | A |
| 81 | A | A | A | A | A |
| 82 | A | A | A | A | A |
| Comparative example | | | | | |
| 71 | B | B | A | B | B |
| 72 | B | B | A | B | B |
| 73 | B | B | A | B | B |
| 74 | B | B | A | B | B |

TABLE 12-continued

| Group | Electro-deposition coating performance | Coating film adhesion | Pin holing resistance | Powdering | Overall evaluation |
|---|---|---|---|---|---|
| 75 | B | A | C | A | B |

Overall evaluation
A: Good; B: Somewhat poor; C: Poor

Possibility of industrial utilization

The steel sheet of this invention has good phosphating performance and corrosion resistance. Accordingly, it can be used for the purposes other than automobile bodies, for example, building materials to be coated, household electrical equipments, utensils for kitchens, etc.

We claim:

1. A multilayer zinc metal electroplated steel sheet comprising (i) a lower layer electroplated coating provided on the surface of the steel sheet and comprising a Zn-Ni base alloy having Ni content of 10 to 16 wt.% or Zn-Fe base alloy having Fe content of 10 to 30 wt.%, containing 0.005 to 5 wt.% of at least one of silica, alumina, titanium oxide, magnesia, chromium oxide and zirconium oxide, and (ii) an upper layer electroplated coating provided on said lower layer electroplated coating and comprising an Fe-B base alloy having B (boron) content of 0.001 to 3 wt.% or an Fe-rich Fe-Zn base alloy having Fe content of 60 wt.% or more.

2. The multilayer zinc metal electroplated steel sheet according to claim 1, wherein the coating weight for said lower layer is 10 to 50 $g/m^2$ per one side, and the coating weight for said upper layer is 0.5 to 10 $g/m^2$.

3. A multilayer zinc metal electroplated sheet according to claim 1 wherein said upper layer comprises an Fe-B base alloy having 0.001 to 3 wt.% boron.

4. A multilayer zinc metal electroplated sheet according to claim 1 wherein said lower layer comprises a Zn-Fe base alloy having an Fe content of 10 to 30 wt.%.

* * * * *